US006122308A

United States Patent [19]

Katayama

[11] Patent Number: 6,122,308

[45] Date of Patent: Sep. 19, 2000

[54] ELECTRIC RESISTANCE TYPE MELTING FURNACE

[75] Inventor: Hideo Katayama, Tokyo, Japan

[73] Assignee: Setsu Anzai, Tokyo, Japan

[21] Appl. No.: 09/359,751

[22] Filed: Jul. 23, 1999

[30] Foreign Application Priority Data

| | | | |
|---|---|---|---|
| Feb. 16, 1999 | [JP] | Japan | 11-076269 |
| May 11, 1999 | [JP] | Japan | 11-004207 |
| May 18, 1999 | [JP] | Japan | 11-004455 |
| Jun. 30, 1999 | [JP] | Japan | 11-185965 |

[51] Int. Cl.[7] ..... H05B 3/62

[52] U.S. Cl. ..... 373/117; 373/134

[58] Field of Search ..... 373/109, 110, 373/111, 117, 118, 119, 132, 133, 134, 135, 136

[56] References Cited

U.S. PATENT DOCUMENTS

| | | | |
|---|---|---|---|
| 4,336,412 | 6/1982 | Thomander | 373/110 |
| 5,251,231 | 10/1993 | Croker et al. | 373/109 |
| 5,265,118 | 11/1993 | Takenaka et al. | 373/117 |
| 5,608,838 | 3/1997 | Brookley | 392/407 |
| 5,894,541 | 4/1999 | Eckert | 392/503 |

*Primary Examiner*—Tu Ba Hoang

*Attorney, Agent, or Firm*—Armstrong, Westerman, Hattori, McLeland & Naughton

[57] ABSTRACT

The electric resistance type melting furnace according to the present invention prevents deformation and destruction of graphite electrodes under high temperature conditions. In a melting furnace 1, graphite electrodes 3*a* and 3*b* each having a rectangular cross-section and with outer surfaces covered with a molybdenum member M are arranged, and surfaces of the graphite electrodes are positioned opposite to each other.

8 Claims, 7 Drawing Sheets

ELECTRIC RESISTANCE TYPE MELTING FURNACE

BACKGROUND OF THE INVENTION

The present invention relates to an electric resistance type melting furnace for melting and disposing of incineration ashes which are generated when general material waste and industrial waste are incinerated.

When general material waste and industrial waste are incinerated at a temperature lower than 900° C., incineration ash is generated. The incineration ash contains such substances and metal components, which are detrimental to environment and harmful to humans and animals. The problems related to these harmful substances, such as PCB, dioxin, lead, cadmium, etc., cannot be solved by an incineration furnace using normal type of fuel. If the incineration ash is discharged to reclaimed land, water pollution or soil pollution naturally occurs. In recent years, it has been reported that metal components are eluted due to acidic rain having a pH value of 3, and this adversely affects drinking water or the like.

To solve this problem, various methods have been proposed in the past in order to make the harmful substances harmless by melting the incineration ash. A furnace using oil and gas cannot be used for this purpose because such furnace requires a large quantity of air for combustion and it is necessary to minimize the quantity of oxygen in the furnace. Thus, an electric furnace is used for this purpose. A high frequency furnace belongs to the category of the electric furnace, but it is difficult to create a space of large capacity high frequency furnace. An electric arc furnace is used generates an arc between molten metal and a graphite electrode and produces a melt by the heat thus generated. Due to a high temperature of more than 3000° C., the furnace is often damaged and the electrodes are worn out, this also requires high power consumption. The most desirable furnace for this purpose must be designed in such manner that the furnace is substantially sealed to exclude the intrusion of the air, and it is essential to use an electric resistance-type melting furnace, which generates heat by utilizing electric resistance to inorganic melt itself and to maintain intra-furnace temperature.

A basic design for the electric resistance type melting furnace is described in Japanese Patent No. 1334791 (JP-B-60-56963). A description will be given now of this patented design referring to FIG. 10. On a ceiling unit 102 of a melting furnace 101, three graphite electrodes 103 for 3-phase AC are penetrating the ceiling member 102 in such manner that these electrodes can be moved up and down. Further, on the ceiling unit 102, there are provided a chute 105 for supplying incineration ash 104, an air inlet 106 for supplying combustion air, and an exhaust port 107. A regulator valve 108 for regulating air quantity is provided at the air inlet 106. At the bottom of the melting furnace 101, a tapping hole 110 for discharging metal melt 109 is arranged.

Electric current is supplied to the electrodes 103, which are immersed into the metal melt 109. By Joule's heat generated by using the metal melt 109 as a resistant substance, heat higher than the melting temperature of the metal melt 109, i.e. 1400° C. to 1500° C., is generated. The incineration ash 104 is supplied through the chute 105 to the entire surface of the metal melt 109. The incineration ash 104, thus supplied, is sequentially melted from the portion in contact with the surface of the metal melt 109, and a small quantity of exhaust gas generated at the melting is discharged through the exhaust port 107. When the incineration ash 104 is melted, metal components contained in the incineration ash are accumulated at the bottom as a molten metal layer. Inorganic melt from the incineration ash is separated and forms a glass layer above the molten metal layer. The molten metal and the inorganic melt are sequentially discharged through the tapping hole 110.

In the meantime, in the initial stage of the melting process, it is necessary to tightly fill iron and copper scraps into the electric resistance type melting furnace around the electrodes 103 at the bottom of the melting furnace 101 and to supply electric current to the graphite electrodes 103 to form the metal melt 109. However, the conventional type electric resistance-type melting furnace, as described above, is low in strength because the electrodes 103 are made of graphite, and when iron or copper scraps are tightly filled, graphite electrodes are destroyed. Also, graphite electrodes may be destroyed when electric current is continuously supplied under high temperature conditions.

Also, in the conventional electric resistance-type melting furnace, as described above, the distance between the electrodes 103 is fixed, and melting temperature of the metal melt 109 cannot be accurately controlled. This leads to higher power consumption and an inability to accurately determine the timing of when to charge incineration ash and also results in longer processing time.

Further, in the conventional electric resistance-type melting furnace as described above, the electrodes 103 are designed with a cylindrical shape regardless of the material used, and a 3-phase electrode is adopted. This means that three cylinder-type electrodes are used at all times. Therefore, electric current between the electrodes is distributed in form of a triangle. Electric current is concentrated at the portion where the distance between the surfaces of the cylinder-type electrodes is shortest. In order to melt the material within a short time, the electrodes must be brought closer to each other. As a result, the melting volume of the metal melt 109 is reduced. Further, unless electric current between the electrodes is distributed evenly, the power factor is decreased, and it is necessary to have a reactor or a condenser for power factor improvement.

SUMMARY OF THE INVENTION

To solve the above problems, it is an object of the present invention to provide an electric resistance-type melting furnace, by which it is possible to prevent deformation and destruction of graphite electrodes under high temperature conditions, to reduce the damage of the electrodes caused by the hitting of waste metal pieces against the electrodes in the initial stage of the operation, and to reduce the processing cost.

To attain the above object, the invention basically provides a melting furnace, which comprises a plurality of graphite electrodes 3*a* and 3*b*, each having a rectangular cross-section and with outer peripheral surfaces, covered with a molybdenum member M, said electrodes being disposed in a melting furnace 1, and surfaces of the graphite electrodes being positioned opposite to each other.

The invention also provides a melting furnace, wherein there are provided two graphite electrodes, and single phase power is supplied to the graphite electrodes.

The invention further provides, a melting furnace, wherein the melting furnace comprises a central electrode 3*a* arranged at the center of the melting furnace 1, and four graphite electrodes 3*b*–3*e* arranged at angular spacing of 90° around the central electrode.

According to another aspect, the invention provides a melting furnace, wherein there are provided a central electrode driving unit 9 for moving the central electrode 3*a* in a vertical direction and peripheral electrode driving units 10*a*–10*d* for moving the peripheral electrodes 3*b*–30*e* in a horizontal direction with respect to the central electrode 3*a*.

The invention further provides a melting furnace, wherein there are provided a plurality of non-contact type temperature sensors 11*a*–11*d* in the melting furnace 1, the electrode driving units being driven according to the temperature of the incineration ash detected by the temperature sensors, and the electric current between the central electrode and the peripheral electrodes is controlled.

The invention still further provides a melting furnace, wherein an opening 23 for moving the peripheral electrodes 3*b*–3*e* is arranged on the upper portion of the melting furnace 1 and foldable sealing plates 12 are disposed on the upper surface of the opening for moving peripheral electrodes.

The invention also provides a melting furnace, wherein non-contact type level sensors 12*a*–12*d* for detecting surface level of the incineration ash layer 5 in the melting furnace 1 are arranged at arbitrary points on an upper portion of the melting furnace, and the charging quantity of the incineration ash is controlled according to signals from the level sensors.

The invention yet further provides a melting furnace wherein a plurality of electrode plates 29, each having a dielectric member 29*a* fixed on one side of a metal plate 29*b*, are attached with spacing in an exhaust gas passage 33 of the melting furnace 1; plasma discharge is induced between the electrode plates 29 by applying high voltage on each of the metal plates 29*b*; and harmful substances such as PCB, dioxin, etc. in the exhaust gas are decomposed and dissociated. The reference numerals attached to the components are given to facilitate the understanding of the present invention and to refer to the attached drawings, and the essential features of the present invention are not limited by any of these numerals,

DETAILED DESCRIPTION OF PREFERRED EMBODIMENTS OF THE INVENTION

Figure 1A:
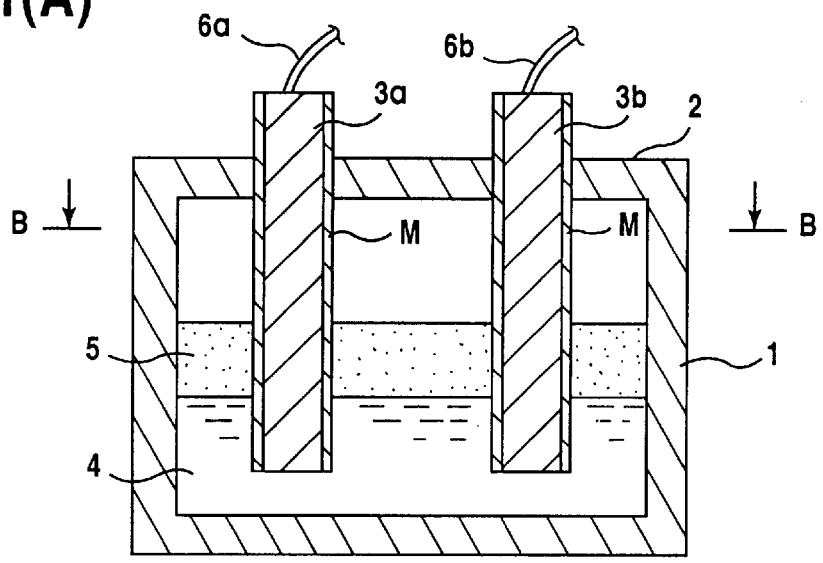
FIG. 1(A) is a longitudinal sectional view of an embodiment of an electric resistance type melting furnace according to the invention.
Figure 1B:
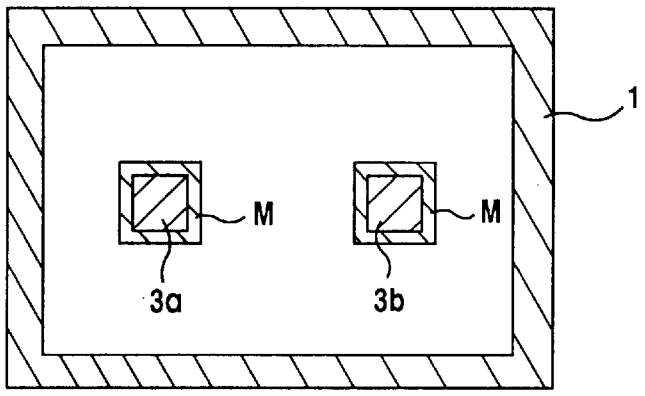
FIG. 1(B) is a cross-sectional view of the embodiment along the line B—B in FIG. 1(A)
Figure 1C:
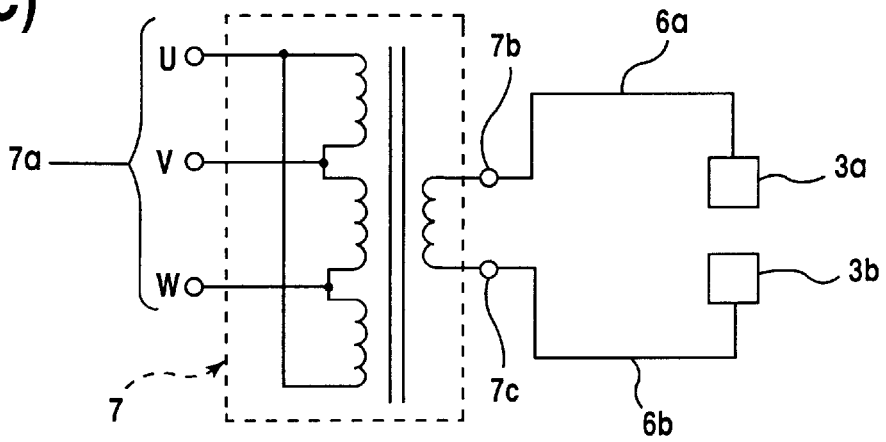
FIG. 1(C) is an electric circuit diagram.

In the following, description will be given on embodiments of the present invention referring to the attached drawings: FIG. 1 shows an embodiment of an electric resistance type melting furnace according to the present invention wherein FIG. 1(A) is a longitudinal sectional view of the embodiment, FIG. 1(B) is a cross-sectional view of the embodiment along the line B—3 in FIG. 1(A), and FIG. 1(C) is an electric circuit diagram;

In FIG. 1(A) and FIG. 1(B), a metal melt 4 in the lower portion of an incineration ash layer 5 is produced by melting of metal waste before the incineration ash layer 5 is melted, and the incineration ash layer 5 is stacked up on upper surface of the metal melt 4. Two graphite electrodes 3*a* and 3*b* each having rectangular cross-section are penetrating a ceiling unit 2 of a melting furnace 1 in such manner that the electrodes can be moved up or down. The outer peripheral surface of each of the graphite electrodes 3*a* and 3*b* is covered with a molybdenum member M, and tips of the electrodes are immersed into the metal melt 4, and the incineration ash layer 5 is placed on the metal melt 4. To the graphite electrodes 3*a* and 3*b* power feeding cables 6*a* and 6*b* are connected respectively. As shown in FIG. 1(C), the power feeding cables 6*a* and 6*b* are connected to power feeding terminals 7*b* and 7*c* of secondary side single phase of a power transformer 7 respectively, and connection terminals U, B and W on primary side 7*a* of the power transformer 7 are connected to a 3-phase power source. In the electrode of the present invention, the outer peripheral surface of the graphite material is covered with molybdenum. This is advantageous in that the structural strength of each electrode can be increased and the electrodes can be used up to the temperature of about 2600° C. As a result, even when incineration ash or waste metal piece hits the electrode, the electrode is not damaged and this reduces the cost for the processing. When the incineration ash layer 5 is melted, it is discharged to outside as a harmless glass-like substance. Harmful or harmless metal materials charged into the melting furnace 1 are melted and are turned to alloy material and are discharged to outside.

Figure 2A:
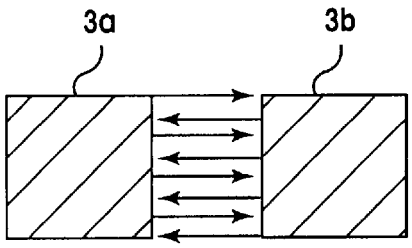
FIGS. 2(A) and 2(B) are drawings to explain the effects of electrodes in the present invention.
Figure 2B:
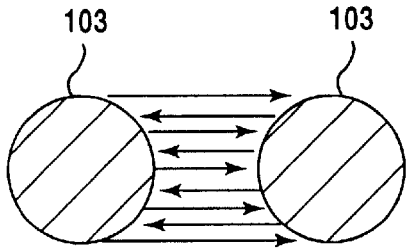

FIG. 2(A) shows effects of the electrodes in the embodiment shown in FIG. 1. In each of these cases, graphite electrodes 3*a* and 3*b*, each having a rectangular cross-section, have the surfaces positioned in opposite facing relation to each other. When electric current is supplied to the graphite electrodes 3*a* and 3*b*, electric current flowing to the metal melt 4 in the melting furnace 1 shows even current distribution. However, in case of the current distribution in conventional cylinder-type electrodes 103, resistance value is not even because the distance between the surfaces of the cylinder type electrodes is different as shown in FIG. 2(B). Therefore, the distance between the cylinder-type electrodes 103 must be reduced in order to obtain strong current required in the melting furnace, and the quantity of the melt to be processed is decreased.

Figure 3A:
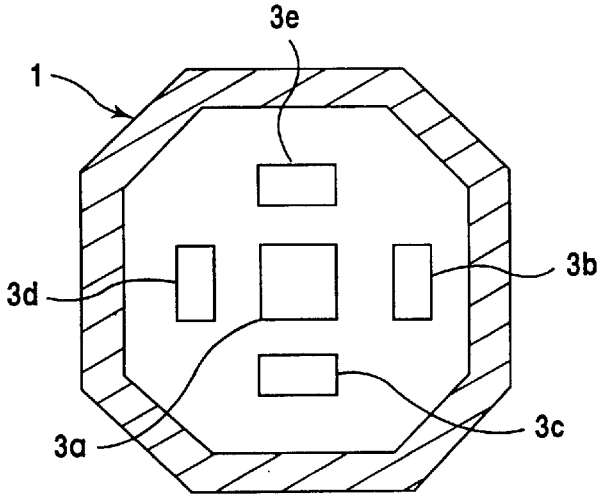
FIG. 3(A) is a horizontal sectional view of the melting furnace.
Figure 3B:
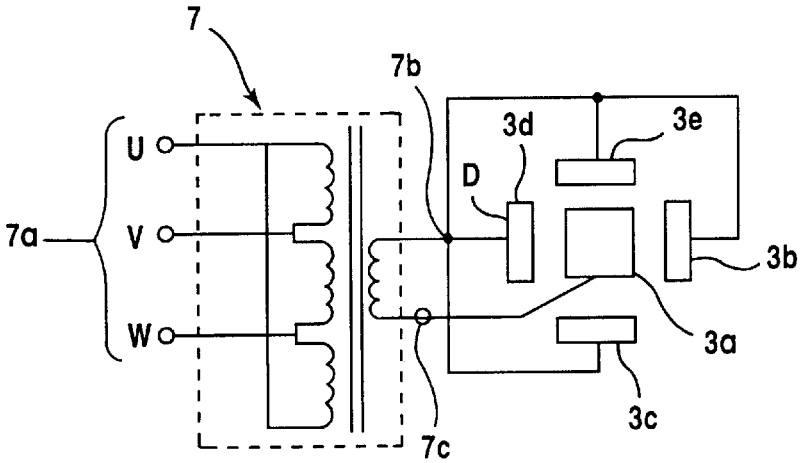
FIG. 3(B) is an electric circuit diagram.

FIG. 3 shows another embodiment of the electric resistance type melting furnace of the present invention. FIG. 3(A) is a horizontal sectional view of the melting furnace, and FIG. 3(B) shows an electric circuit diagram. In this embodiment, five graphite electrodes 3*a*–3*e,* each having a rectangular cross-section and covered with a molybdenum member are provided. The graphite electrode 3*a* is arranged at the center of the melting furnace 1, and peripheral electrodes 3*b*, 3*c*, 3*d* and 3*e* are arranged at equal angular spacing around the central electrode 3*a*. Each of the peripheral electrodes 3*b*–3*e* is connected to a secondary side terminal 7*b* of a transformer 7, and the central electrode 3*c* is connected to a secondary side terminal 7*c*. The horizontal cross-section or the melting furnace 1 is designed with a polygonal shape. Compared with the furnace having a rectangular cross-section, the temperature of the melt can be maintained at an even level.

Figure 4A:
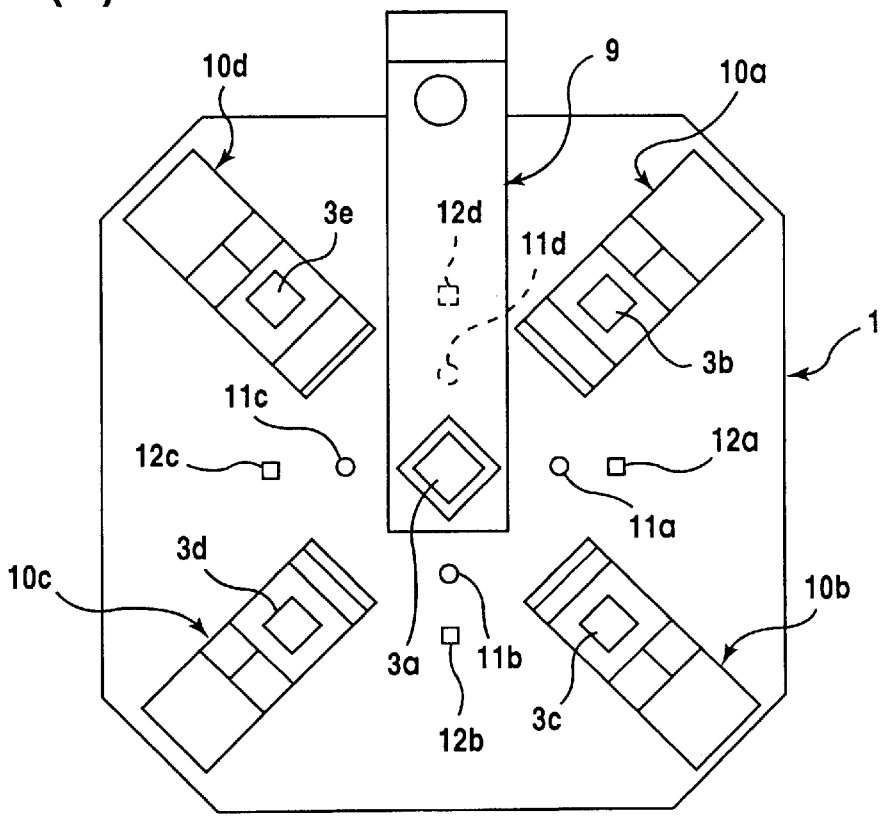
FIG. 4(A) is a plan view of the melting furnace.
Figure 4B:
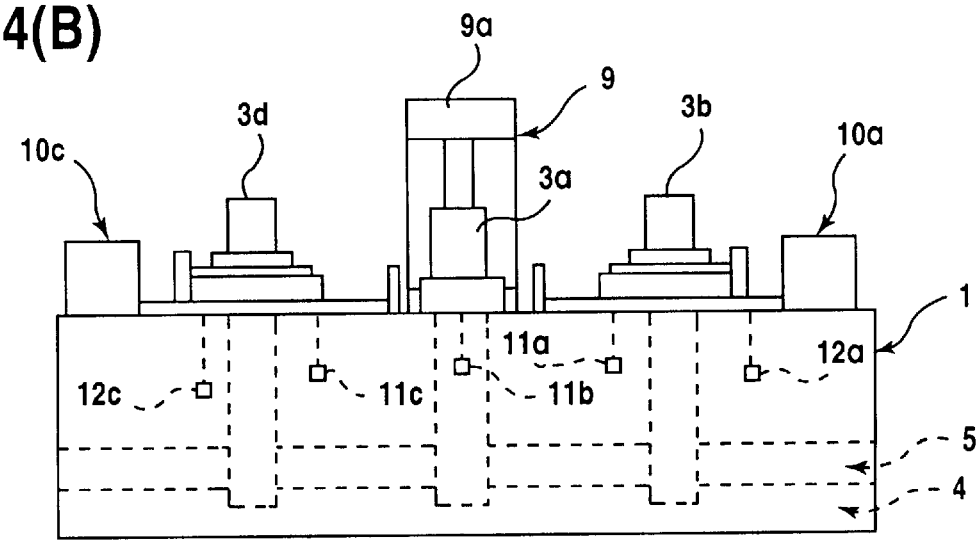
FIG. 4(B) is a front view of the melting furnace.
Figure 5A:
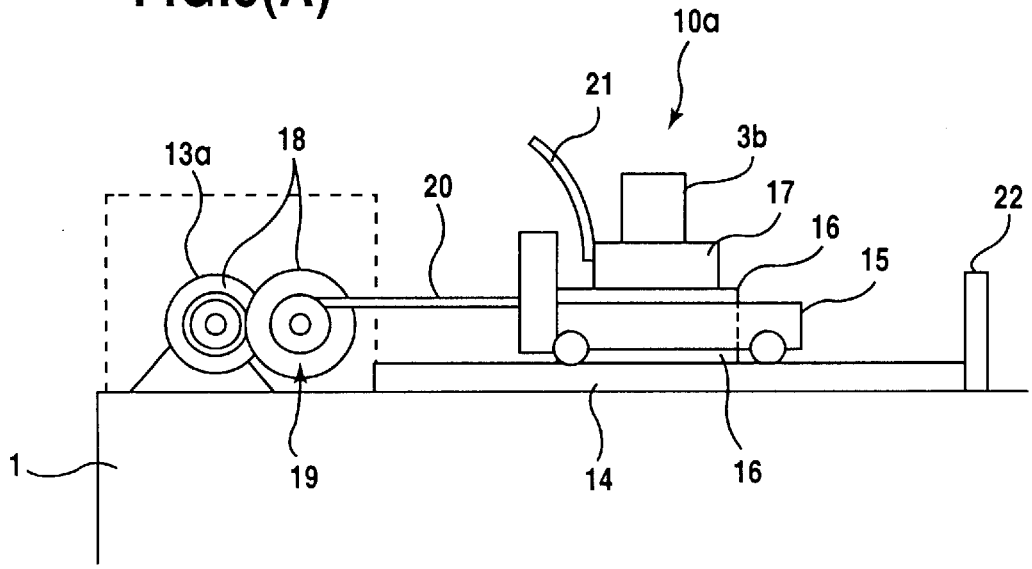
FIG. 5(A) shows a side view of an arrangement of an electrode driving unit 10*a* of a movable electrode 3*b*.
Figure 5B:
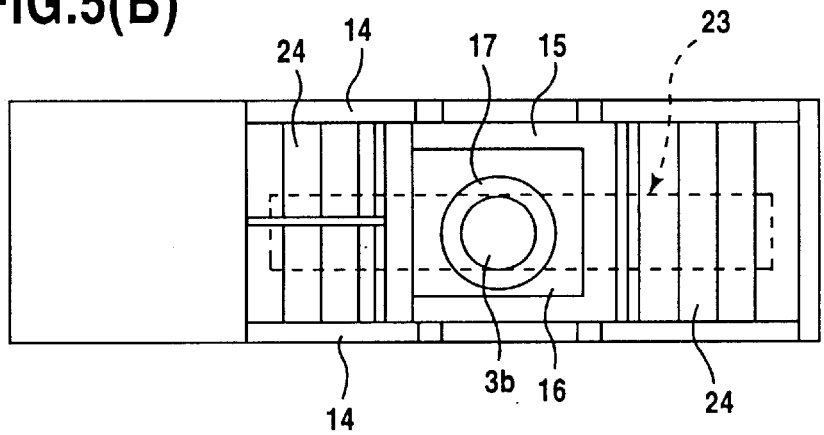
FIG. 5(B) is a plan view of the arranagement.
Figure 5C:
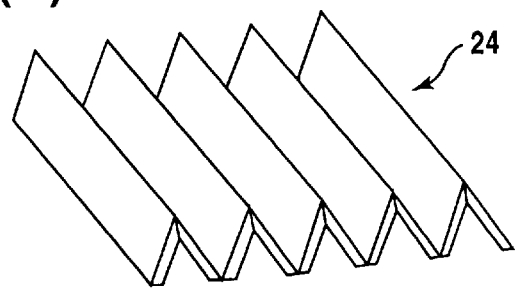
FIG. 5(C) is a perspective view of a cover member.
Figure 6:
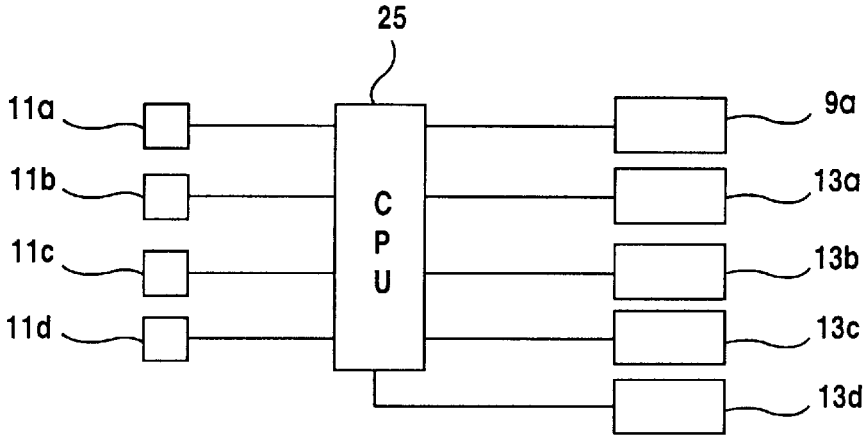
FIG. 6 is a block diagram of a control system used in an embodiment of the invention.

FIG. 4 to FIG. 6 each represents another embodiment of the electric resistance type melting furnace. FIG. 4(A) is a plan view of the melting furnace, and FIG. 4(B) is a front view of the melting furnace. This embodiment is an improved variation of the embodiment shown in FIG. 3. The peripheral electrodes 3*b*–3*e,* as shown in FIG. 3 are moved in a horizontal direction with respect to the central electrode 3*a* so that electric current flowing between the central electrode 3*a* and each of the peripheral electrodes 3*b*–3*e* is made variable.

In FIGS. 4(A) and 4(B) the central electrode 3*a* is arranged at the center of the melting furnace 1, and the peripheral electrodes 3*b*, 3*c*, 3*d* and 3*e* are arranged around the central electrode 3*a*. Each of the movable electrodes 3*b*–3*e* is arranged at each of four positions at equal angular spacing of 90° around the central electrode 3*a* so that these electrodes are moved toward or away from the central electrode 3*a* on the horizontal plane. The central electrode 3*a* is mounted on a central electrode driving unit 9 so that the central electrode 3*a* can be moved up or down in vertical direction by an electric motor 9*a*. The peripheral electrodes 3*b*–3*e* are mounted on peripheral electrode driving units 10*b*, 10*c*, 10*d* and 10*e* respectively. As a result, each of the peripheral electrodes 3*b*–3*e* can be moved toward or away from the central electrode 3*a*. Between the central electrode 3*a* and the peripheral electrodes 3*b*–3*e*, non-contact type temperature sensors 11*a*, 11*b*, 11*c* and 11*d* for detecting temperature of each portion in the incineration ash layer 5 are arranged. In the upper portion in the melting furnace 1, non-contact type level sensors 12*a*, 12*b*, 12*c* and 12*d* for detecting surface level of the incineration ash layer 5 are provided. Using ultrasonic wave or electromagnetic wave, which does not affect internal temperature of the melting furnace 1, the level sensors 12*a*–12*d* detect the surface level of the incineration ash layer 5 in the melting furnace 1. By injecting incineration ash through an injection port (not shown) for incineration ash on the upper portion of the melting furnace 1, the incineration ash layer 5 can be controlled to a predetermined level.

FIGS. 5(A) to 5(C) shows an arrangement of the peripheral electrode driving unit 10*a* of the peripheral electrode 3*b* shown in FIG. 4. FIG. 5(A) is a side view, FIG. 5(B) is a plan view, and FIG. 5(C) is a perspective view of a cover member. Each of the other peripheral electrode driving units 10*b*–10*d* has the same arrangement.

On the upper surface of the melting furnace 1, an electric motor 13*a* and two guide rails 14 inclined toward the central electrode 3*a* are provided, and an electrode transport trolley 15 is placed between the guide rails 14. On the electrode transport trolley 15, an electrode support member 17 is mounted and supported via an insulation member 16, and the peripheral electrode 3*b* is fixed on the electrode support member 17. On the output shaft of the motor 13, a winder 19 is provided via a speed reducing gear mechanism 18, and the electrode transport trolley 14 is connected to a wire cable 20 which is wound up on the winder 19. To the electrode support member 17, a power feeding cable 21 is connected. At an end of the guide rail 14, a stopping member 22 is erected to indicate the shortest distance when the electrode transport trolley 14 is brought closer to the central electrode 3*a*. On top of the melting furnace 1, an opening 23 for moving each electrode is formed. It is necessary to provide sealing so that heat and gas in the melting furnace 1 are not blown up to outside through the opening 23 for moving electrode. For this purpose, foldable sealing plates 24 and 24 are arranged on left and right sides of the insulation member 16 between the guide rails 14 so that the opening 23 for moving electrode can be sealed when the peripheral electrode 3*b* is moved. Because the guide rails 14 and 14 are inclined toward the central electrode 3*a*, when electric current between the central electrode 3*a* and the peripheral electrodes 3*b*–3*e* is increased, the motor 13*a* is rotated in the reverse direction. Then, the wire cable 20 is loosened, and the trolley is moved closer to the central electrode 3*a*.

FIG. 6 is a block diagram of a control system of the embodiment shown in FIG. 4. Based on temperature data from the temperature sensors 11*a*–11*d* mounted inside the melting furnace 1, an automatic control unit 25 controls rotation of motors 9*a* and 13*a*–13*d* arranged on the central electrode driving unit 9 and the peripheral electrode driving units 10*a*–10*d* in normal or reverse direction. Then, the electrode transport trolley 15 is moved toward or away from the central electrode 3*a*. Electric current between the central electrode 3*a* and the peripheral electrodes 3*b*–3*e* is increased or decreased, and melting temperature of the incineration ash layer 5 in the melting furnace 1 is maintained at a predetermined temperature level. When the predetermined melting temperature of the incineration ash layer 5 is extensively changed, the motor 9*a* is driven by the automatic control unit 25 and the central electrode 3*a* is move up or down. In case the melting temperature differs at each position of the incineration ash layer 5 in the melting furnace 1, it is possible to separately drive each of the peripheral electrode driving units 10*a*–1*d* depending on the difference of temperature.

As shown in FIG. 3(B), the secondary side of the transformer 7 is designed as a single phase circuit, and the peripheral electrodes 3*b*–3*e* are commonly connected and are positioned opposite to the central electrode 3*a*. As a result, the difference of electric current between the central electrode 3*a* and the peripheral electrodes 3*b*–3*e* is not turned to an extreme value, and this means less change will occur in the melting temperature of the incineration ash layer 5. It is a single phase power feeding circuit when the melting temperature is adjusted. In case two or more electrodes are used, the electrodes can be separately moved in horizontal directions. Electric current between the electrodes can be freely adjusted, and this is advantageous in that there is no need to use power factor improvement reactor, which is required in the case of a 3-phase circuit cylinder type electrode.

Figure 7A:
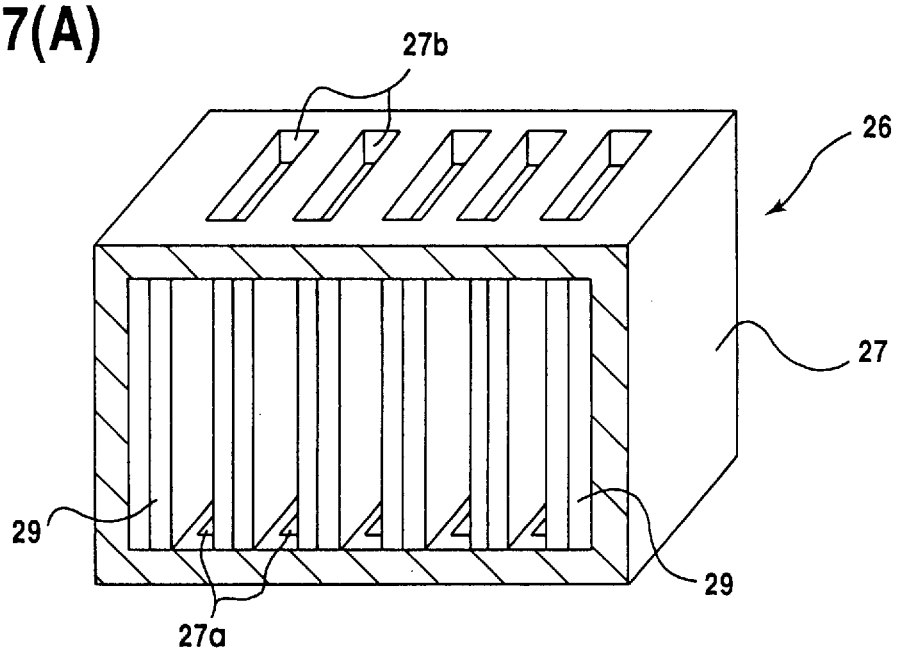
FIG. 7(A) is a perspective view showing a partial cross-section of an exhaust gas purifier adapted for use in the present invention.
Figure 7B:
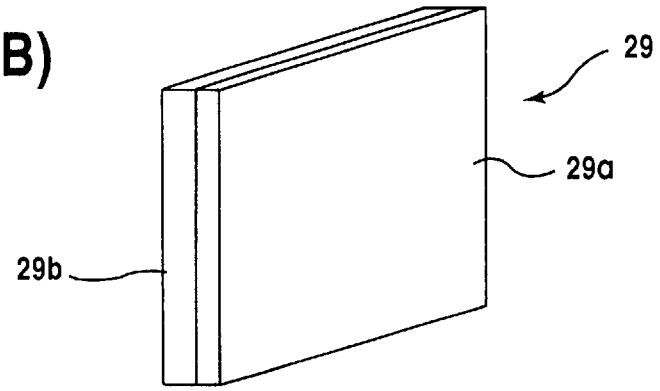
FIG. 7(B) is a perspective view of an electrode plate shown in FIG. 7(A)

Next, description will be given of an exhaust gas purifier adopted for use in the electric resistance-type melting furnace of the present invention referring to FIGS. 7(A) and 7(B)–FIG. 9. FIG. 7(A) is a perspective view showing a partial cross-section of an exhaust gas purifier, and FIG. 7(B) is a perspective view of an electrode plate of FIG. 7(A). It goes without saying that the exhaust gas purifier may be applied to an exhaust gas passage in a material waste incineration furnace.

An exhaust gas purifier 26 comprises an electric insulator case 27 made of a heat-resistant materials a plurality of exhaust gas inlets 17*a* formed on the bottom of the case 27, an exhaust outlet 27*b* formed on upper surface of the case 27, and a plurality of electrode plates 29 erected with spacing and arranged in parallel and in vertical direction inside the case 27. The electrode plate 29 comprises a dielectric member 29*a* made of glass or quartz having a dielectric constant closer to 1 and a metal plate 29*b* fixed on the dielectric member.

Figure 8:
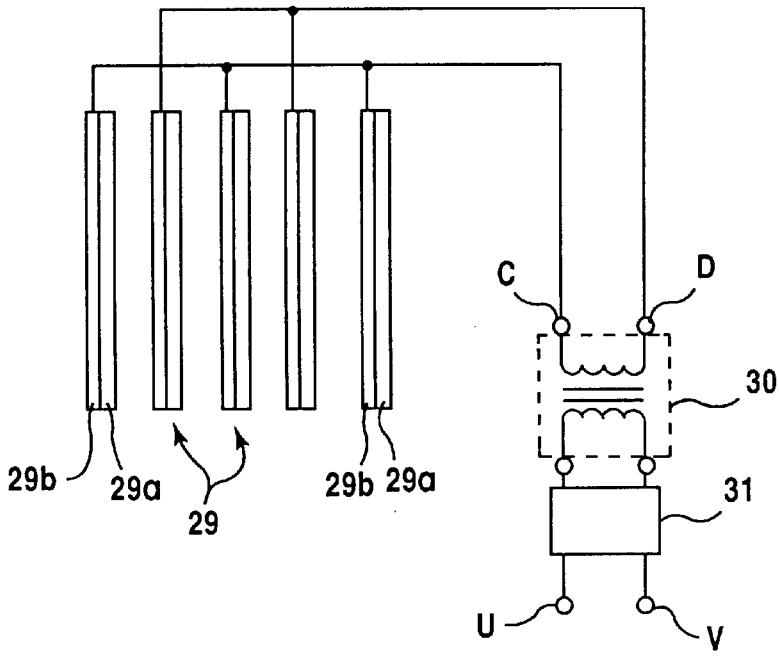
FIG. 8 shows an electric circuit of FIG. 7(A)

FIG. 8 is an electric circuit diagram of the exhaust gas purifier shown in FIG. 7(A). Low voltage is applied to primary side connection terminals U and V of the transformer 30, and high voltage is generated between high voltage terminals C and D on the secondary side. By applying high voltage between metal plates 29*b* connected to the high voltage connection terminals C and D, plasma discharge is induced between the electrode plates 29 and 29. A sliduck (volt slider) 31 is used to select intensity of plasma discharge by varying voltage between high voltage terminals C and D depending on components of the exhaust gas passing between the electrode plates 29. By plasma discharge induced by high voltage between the high voltage terminals C and D, the exhaust gas passes through a plurality of exhaust gas inlets 29*a* on the bottom of the electric insulator case 1, and when it reaches the electrode plates 29, harmful substances such as PCB, dioxin, etc. in the exhaust gas are decomposed and dissociated.

Figure 9:
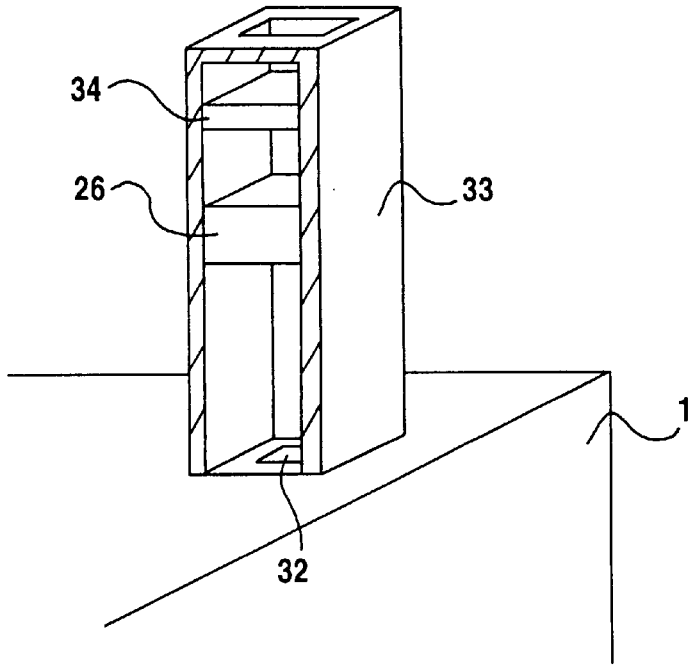
FIG. 9 is a perspective view of an exhaust gas purifier mounted on the electric resistance type melting furnace of the present invention.
Figure 10:
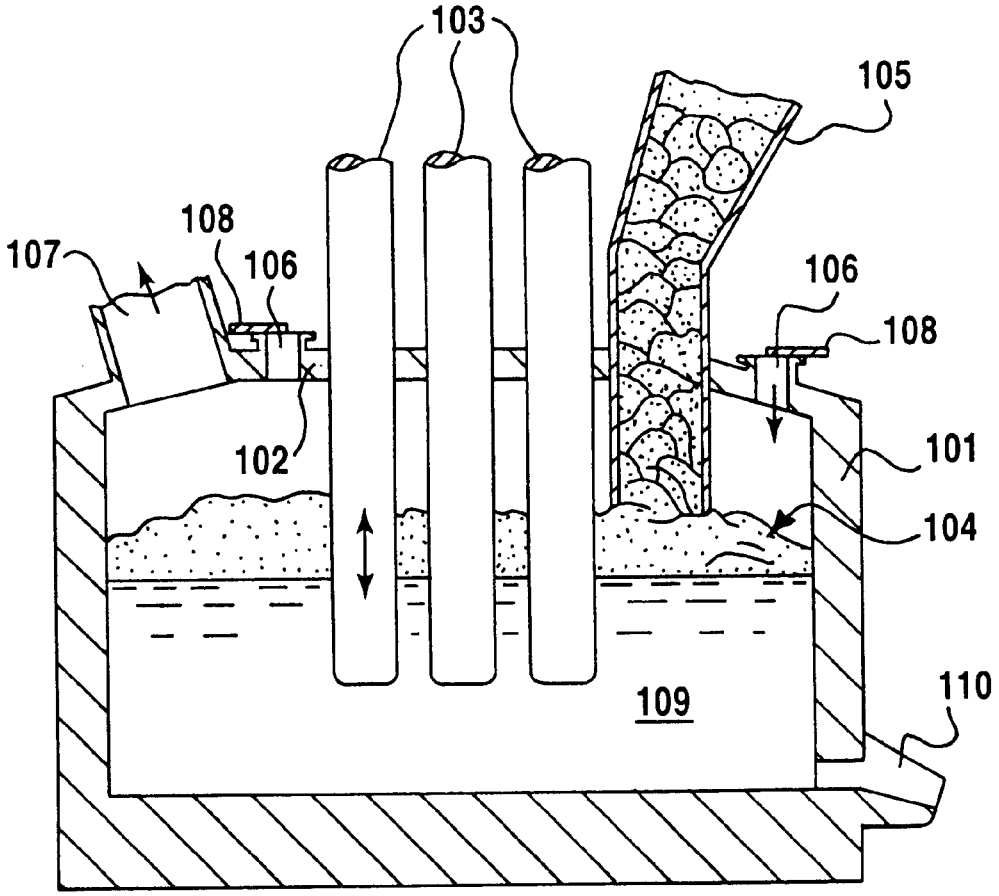
FIG.10 PRIOR ART
FIG. 10 is a perspective view of a conventional electric resistance-type melting furnace.

FIG. 9 is a perspective view of the electric resistance-type melting furnace of the present invention provided with the exhaust gas purifier 26. An exhaust gas duct (exhaust gas passage) 33 is erected on an exhaust gas outlet 32 of the melting furnace 1, and the exhaust gas purifier 26 and a carbon filter 34 are arranged in the exhaust gas duct 33. The carbon filter 34 is used to absorb gas and eliminate odor in the exhaust gas duct 33.

As it is evident from the above description, it is possible according to one aspect of the invention to prevent deformation and destruction of graphite electrodes under high temperature because outer surfaces of the graphite electrodes are covered with molybdenum members. Also, it is possible to eliminate damage of the electrodes caused by the hitting of waste metal pieces against the electrodes in the initial stage of operation, and this leads to the reduction of processing cost. Because the electrodes have a rectangular cross-section, spacing between electrode plates is uniform, and this contributes to even distribution or electric current. Further, melting temperature can be increased to higher than the melting temperature in the conventional type of melting furnace, i.e. to 1500° C. to 2000° C. This makes it possible to eliminate harmful substances such as dioxin, carbon monoxide, PBC, etc. or to reduce the content of such substances to lower than tho standard values, and this contributes to solve pollution problems. According to another aspect of the invention, the number of electrodes can be reduced. Further, according to the invention, the peripheral electrodes are moved toward or away from the central electrode depending on the detection value of the temperature sensors in the melting furnace. As a result, the melting temperature of the incineration ash layer in the melting furnace can be quickly and automatically controlled, and power consumption for the melting of the incineration ash layer can be decreased.

Also, according to the invention, gas in the melting furnace can be sealed when the peripheral electrodes are moved. According to another aspect of the invention, the level of the incineration ash layer in the furnace can be detected, and this makes it possible to accurately control charging quantity of the incineration ash to be melted. According to yet another aspect of the invention, harmful gases in the exhaust gas discharged from the melting furnace can be decomposed and dissociated.

What is claimed is:

1. An electric resistance type melting furnace, comprising a plurality of graphite electrodes, each having a rectangular cross-section and having outer peripheral surfaces covered with a molybdenum member, said graphite electrodes being disposed inside the melting furnace, and side surfaces of respective of said graphite electrodes being positioned in opposite facing relation to each other.

2. An electric resistance type melting furnace according to claim 1, wherein there are provided two of said graphite electrodes, and single phase power is supplied to the graphite electrodes.

3. An electric resistance type melting furnace according to claim 1, wherein said plurality of graphite electrodes in said melting furnace comprises a central electrode arranged at about the center of the melting furnace, and four peripheral electrodes arranged with angular spacing of 90° around the central electrode.

4. An electric resistance type melting furnace according to claim 3, wherein there are provided a central electrode driving unit for moving said central electrode in a vertical direction, and peripheral electrode driving units for moving peripheral electrodes in horizontal directions with respect to said central electrode.

5. An electrode apparatus in the incineration ash melting furnace according to claim 4, wherein there are provided a plurality of non-contact type temperature sensors in the melting furnace, said electrode driving units being driven according to a temperature of incineration ash detected by said temperature sensors, and the electric current between the central electrode and the peripheral electrodes being controlled.

6. An electric resistance type melting furnace according to claim 4, wherein an opening for moving the peripheral electrodes is arranged in an upper portion of the melting furnace, and foldable sealing plates are disposed on an upper surface of said opening for moving said peripheral electrodes.

7. An electric resistance type melting furnace according to any one of claims 1 to 6, wherein non-contact type level sensors for detecting a surface level of a layer of incineration ash in the melting furnace are provided at selected locations on an upper portion of the melting furnace, and a charging quantity of the incineration ash is controlled according to a signal from said level sensors.

8. An electric resistance type melting furnace according to any one of claims 1 to 6, wherein said electrode plates each have a dielectric member fixed on one side of a metal plate and are disposed in mutually spaced relation within an exhaust gas passage of the melting furnace, whereby plasma discharge is induced between said electrode plates by applying high voltage on each of the metal plates, and harmful substances in the exhaust gas are decomposed and dissociated.

* * * * *